US007353742B1

(12) United States Patent
Sirkis et al.

(10) Patent No.: US 7,353,742 B1
(45) Date of Patent: Apr. 8, 2008

(54) DOUBLE ACTION FIRING PIN SYSTEM

(75) Inventors: Nehemia Sirkis, Hollywood, FL (US); Amir Zonshine, Hartsdale, NY (US)

(73) Assignee: Kimber IP, LLC, Yonkers, NY (US)

( * ) Notice: Subject to any disclaimer, the term of this patent is extended or adjusted under 35 U.S.C. 154(b) by 0 days.

(21) Appl. No.: 11/099,028

(22) Filed: Apr. 5, 2005

(51) Int. Cl.
*F41A 19/29* (2006.01)

(52) U.S. Cl. ..... 89/196; 42/69.02

(58) Field of Classification Search ..... 89/196, 89/179; 42/69.01, 69.02, 69.03
See application file for complete search history.

(56) References Cited

U.S. PATENT DOCUMENTS

| | | | | |
|---|---|---|---|---|
| 580,924 | A | 4/1897 | Browning | |
| 2,776,602 | A | 1/1957 | Sturtevant | |
| 2,889,753 | A | 6/1959 | Whitney | |
| 4,201,113 | A | 5/1980 | Seecamp | |
| 5,086,579 | A * | 2/1992 | Flatley et al. | 42/70.08 |
| 5,309,815 | A | 5/1994 | Möller et al. | |
| 5,355,768 | A * | 10/1994 | Felk | 89/147 |
| 5,386,659 | A * | 2/1995 | Vaid et al. | 42/69.02 |
| 5,437,120 | A * | 8/1995 | Dornaus | 42/70.08 |
| 5,581,046 | A | 12/1996 | Weldle et al. | |
| 5,604,326 | A * | 2/1997 | Lescure | 89/26 |
| 5,654,519 | A | 8/1997 | Albrecht et al. | |
| 5,678,342 | A * | 10/1997 | Felk | 42/69.02 |
| 5,701,698 | A * | 12/1997 | Wesp et al. | 42/69.02 |
| 5,741,996 | A * | 4/1998 | Ruger et al. | 89/196 |
| 5,797,206 | A * | 8/1998 | Vitorino | 42/69.03 |
| 6,070,512 | A * | 6/2000 | Rohrbaugh | 89/147 |
| 6,145,234 | A * | 11/2000 | Fluhr | 42/70.08 |
| 2001/0037596 | A1 * | 11/2001 | Salvitti | 42/70.08 |

* cited by examiner

*Primary Examiner*—Bret Hayes
(74) *Attorney, Agent, or Firm*—Caesar, Rivise, Bernstein, Cohen & Pokotilow, Ltd.

(57) ABSTRACT

A firing pin system for a firearm, including a breech block, a firing pin slidably disposed in the breech block and a single firing pin coil spring adapted to both urge the firing pin toward a cartridge in a barrel of the firearm when the firearm is fired and, subsequent to firing, to urge the firing pin back away from the cartridge such that the firing pin does not protrude through a breach face of a breach block of the firearm subsequent to firing.

3 Claims, 3 Drawing Sheets

DOUBLE ACTION FIRING PIN SYSTEM

BACKGROUND OF THE INVENTION

Field of Invention

This invention relates generally to automatic breech loading firearms, and more specifically to firearms of the Browning-type having a tilting barrel.

In a firearm of the present type, several operations (including unlocking and opening of the breech after firing a shot, the ejection of the empty cartridge shell, the cocking of the hammer, the presentation and introduction of a new cartridge to the chamber of the barrel, and the closing and locking of the breech) are automatically effected by, or through the energy of the recoil of the breech block or bolt carrier or that part which, at the time of the firing of the shot, closes the breech of the barrel.

For purposes of illustration, the type of firearm of the present invention is a .45 caliber pistol and is a locked-breechbolt, recoil-operated gun. In these guns, the barrel and slide are locked together by tilting the barrel so that locking ribs on the upper side of the barrel are engaged in locking surfaces in the top inside surface of the slide. The construction and operation of these pistols is what is referred to generally herein as "slide-type automatic pistols", this term being intended to encompass any pistol having a barrel and breech-bolt slide that are relatively movable into and out of breech-closing, or battery, position with respect to each other. In the battery position, the slide of the pistol is always positively locked with the barrel.

The barrel of such a pistol interlocks with the breech before the weapon is fired. When the weapon is fired, the barrel and breech assembly moves back due to the force of recoil. During this motion, the interlocking mechanism opens and the barrel and breech complete the motion separately. The barrel initially encounters an obstacle, usually the frame. The Breech moves against the force of a recuperator spring and also encounters an obstacle, and usually the frame.

In a Browning type tilting barrel system, as shown, for example, in U.S. Pat. No. 5,581,046 (Weldle), the complete reference of which is fully incorporated by reference hereto, a rebounding firing pin is a necessity. If after firing, the firing pin nose remains protruding through the breech face dwelling in the primer, it will interfere with the barrel from tilting down for unlocking. On the other hand, when in the feeding mode, a protruding firing pin nose will obstruct free passage of the head of the upcoming cartridge. At unlocking (after firing) and at feeding, in no way should the firing pin nose protrude due to spring pressure through the breech face level.

In prior art striker systems, typically, there are separate springs to drive the firing pin for firing and to retract it. It would be beneficial to provide a less complex system that uses only a single spring that would be less expensive, and very reliable.

All references cited herein are incorporated herein by reference in their entireties.

BRIEF SUMMARY OF THE INVENTION

A firing pin system for a firearm is provided which includes a breech block, a firing pin slidably disposed in the breech block, and a single firing pin coil spring adapted to both urge the firing pin toward a cartridge in a barrel of the firearm when the firearm is fired and, subsequent to firing, to urge the firing pin back away from the cartridge. In this system, the firing pin does not protrude through the breach face of a breach block of the firearm subsequent to firing.

More specifically, a firing pin system for a firearm is provided which includes a breech block, and a firing pin slidably disposed in the breech block. The firing pin has an elongated body portion having a first end and a second end and a head section integral to the first end of the elongated body portion. The head section has a larger cross sectional shape than the elongated body portion. The head section also has a first end and a second end. The first end of the head section has an integral firing pin nose. The second end of the head section receives a first spring stop. A cocking piece is integral to the second end of the elongated body portion. A coil spring surrounds the body portion of the firing pin. The breech block has a first aperture of a first cross sectional area adapted to slidably receive the firing pin nose. The breech block has a second aperture of a second cross sectional area to slidably receive the head section of the firing pin. The second aperture is coaxial to the first aperture and is of a larger cross sectional area such that a first shoulder is formed between the first aperture and the second aperture. The shoulder prevents the firing pin from exiting the breech block. The breech block has a third aperture of a third cross sectional area to receive the head section of the firing pin and the coil spring. The third aperture is coaxial to the first aperture and the second aperture and has a larger cross sectional area such that a second shoulder is formed between the second aperture and the third aperture. A first spring stop and a second spring stop are provided where the first spring stop is slidably disposed on the elongated body portion of the firing pin adjacent to the head section at the second shoulder and the second spring stop is slidably disposed on the elongated body portion of the firing pin adjacent to the cocking piece. The coil spring is positioned between the two spring stops to urge the first spring stop against the second end of the head section of the firing pin and to simultaneously urge the second spring stop toward the cocking piece.

Preferably, the first spring stop and the second spring stop are washers. Preferably, the first, second and third cross sectional areas are generally circular.

BRIEF DESCRIPTION OF SEVERAL VIEWS OF THE DRAWINGS

The invention will be described in conjunction with the following drawings in which like reference numerals designate like elements and wherein.

DETAILED DESCRIPTION OF THE INVENTION

The invention will be illustrated in more detail with reference to the following embodiments, but it should be understood that the present invention is not deemed to be limited thereto.

Figure 1:
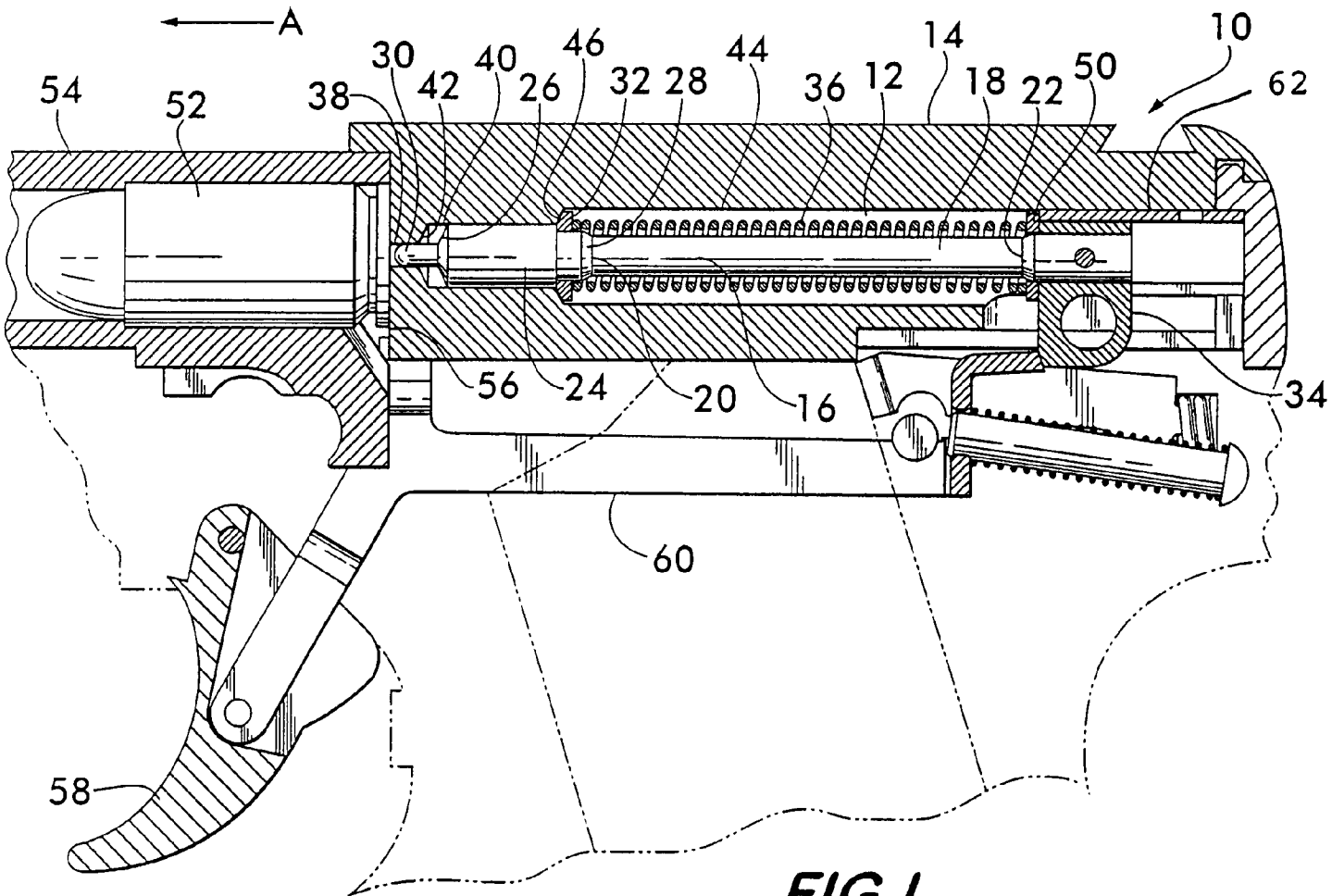
FIG. 1 is a partial, cross-sectional view of a firearm having a double action firing system in accordance with one preferred embodiment of the present invention, wherein the firing system is shown in an at rest condition.

Referring now to the drawings, wherein like part numbers refer to like elements throughout the several views, there is shown in FIG. 1 a partial, cross sectional view of a firearm 10 having a double action firing pin system 12 in accordance with one preferred embodiment of the present invention. The present invention is directed to a unique firing pin system 12 for a firearm 10 that includes a specially designed breech block 14. The firing pin 16 of the firearm 10 is slidably disposed in the breech block 14. The firing pin 16 is of a special design that includes an elongated body portion 18 having a first end 20 and a second end 22. The firing pin 16 also includes a head section 24 integral to the first end 20 of the elongated body portion 18 of the firing pin 16. The head section 24 has a larger cross sectional shape than that of the elongated body portion 18 of the firing pin 16. For example, where the cross-sectional shape of the body portion 18 of the firing pin 16 is circular, the cross sectional shape of the head section 24 is also circular, but having a larger diameter than that of the body portion 18. The head section 24 also has a first end 26 and a second end 28. The first end 26 of the head section 24 has an integral firing pin nose 30. The second end 28 of the head section is a surface that receives a spring stop in the form of first washer 32.

A cocking piece 34, as known, is integral to the second end 22 of the elongated body portion 18 of the firing pin 16. A biasing means, such as a coil spring 36 surrounds the body portion 18 of the firing pin 16 and will be described in further detail below.

The breech block 14 has a stepped three-part aperture in the form of a stepped bore that is preferably circular in cross section. The first aperture 38 is of a first, smallest cross sectional area to slidably receive only the firing pin nose 30. The remaining parts of the firing pin 16 are larger than the first aperture 38 such that they cannot pass through the first aperture 38. The second aperture 40 of the breech block 14 is of a second cross sectional area and is adapted to slidably receive the head section 24 of the firing pin 16. The second aperture 40 is coaxial to the first aperture 38 and is of a larger cross sectional area such that a first shoulder 42 is formed between the first aperture 38 and the second aperture 40. The first shoulder 42 prevents the head section 24 of the firing pin 16 (and therefore, the entire firing pin 16) from exiting the breech block 14. The breech block also has a third aperture 44 having a (third) cross sectional area to receive the head section 24 of the firing pin 16 and the coil spring 36. The third aperture 44 is coaxial with the first aperture 38 and the second aperture 40 and has a larger cross sectional area such that a second shoulder 46 is formed between the second aperture 40 and the third aperture 44.

The spring stop in the form of first washer 32 and a spring stop in the form of second washer 50 are also provided. The first washer 32 is slidably disposed on the elongated body portion 18 of the firing pin 16 adjacent to the head section 24 at the second shoulder 46. The second washer 50 is slidably disposed on the elongated body portion 18 of the firing pin 16 against the split bushing for guiding the cocking piece 62 and adjacent to the cocking piece 34. The coil spring 36 is positioned between the two washers 32, 50 to urge the first washer 32 against the second end 28 of the head section of the firing pin 16 and to simultaneously urge the second washer 50 toward the cocking piece 34.

As can be seen in FIG. 1 which depicts the firing system 12 in an at rest condition, spring 36 is located between the first washer 32 and the second washer. The combined length of the head section of the firing pin 24 and the nose of the firing pin 30 is less than or equal to the length of the first and second apertures 38, 40 in the breech block 14. Therefore, when the firing system 12 is in an at rest condition, as shown in FIG. 1, the nose 30 of the firing pin 16 does not protrude beyond the breech face 56.

Figure 2:
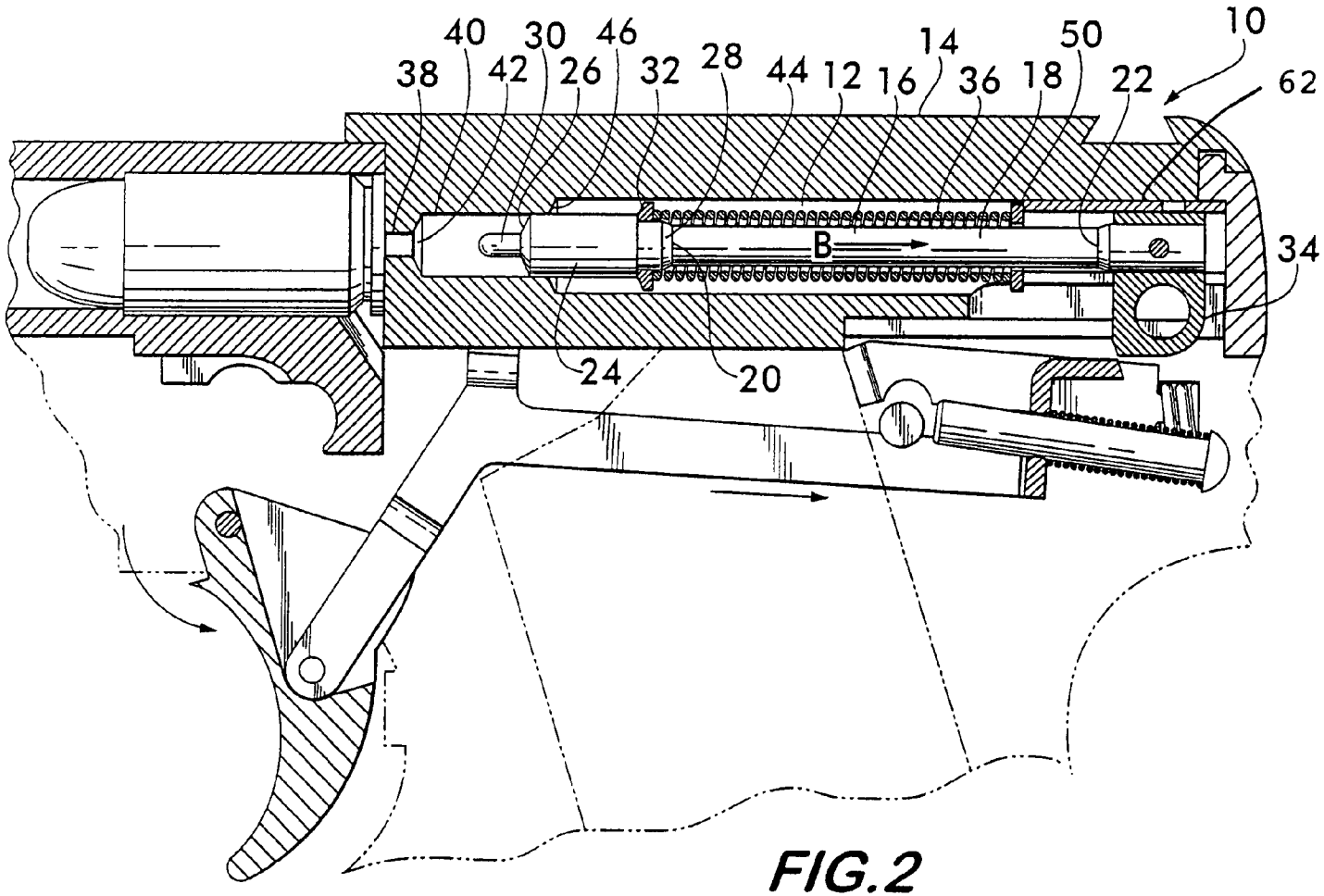
FIG. 2 is a partial, cross-sectional view of the firearm having a double action firing system of FIG. 1, wherein the firing system is shown in a fully cocked position.

FIG. 2 shows the firing system 12 when the firing pin 16 is in a fully cocked position. Here, as compared to the rest position of FIG. 1, the firing pin 16 (including the cocking piece 34) is moved back in the breech block 14, the first washer 32 withdraws from the second shoulder 46 because the head section 24 of the firing pin 16 pushes the first washer 34 back in direction B, and the second washer remains abutted against a split bushing 62 for guiding the cocking piece 34 due to the spring 36 force. A gap is formed between the second washer 50 and the cocking piece 34 and, therefore, the distance between the first washer 32 and the second washer 50 is decreased relative to the "at rest" position of FIG. 1.

Figure 3:
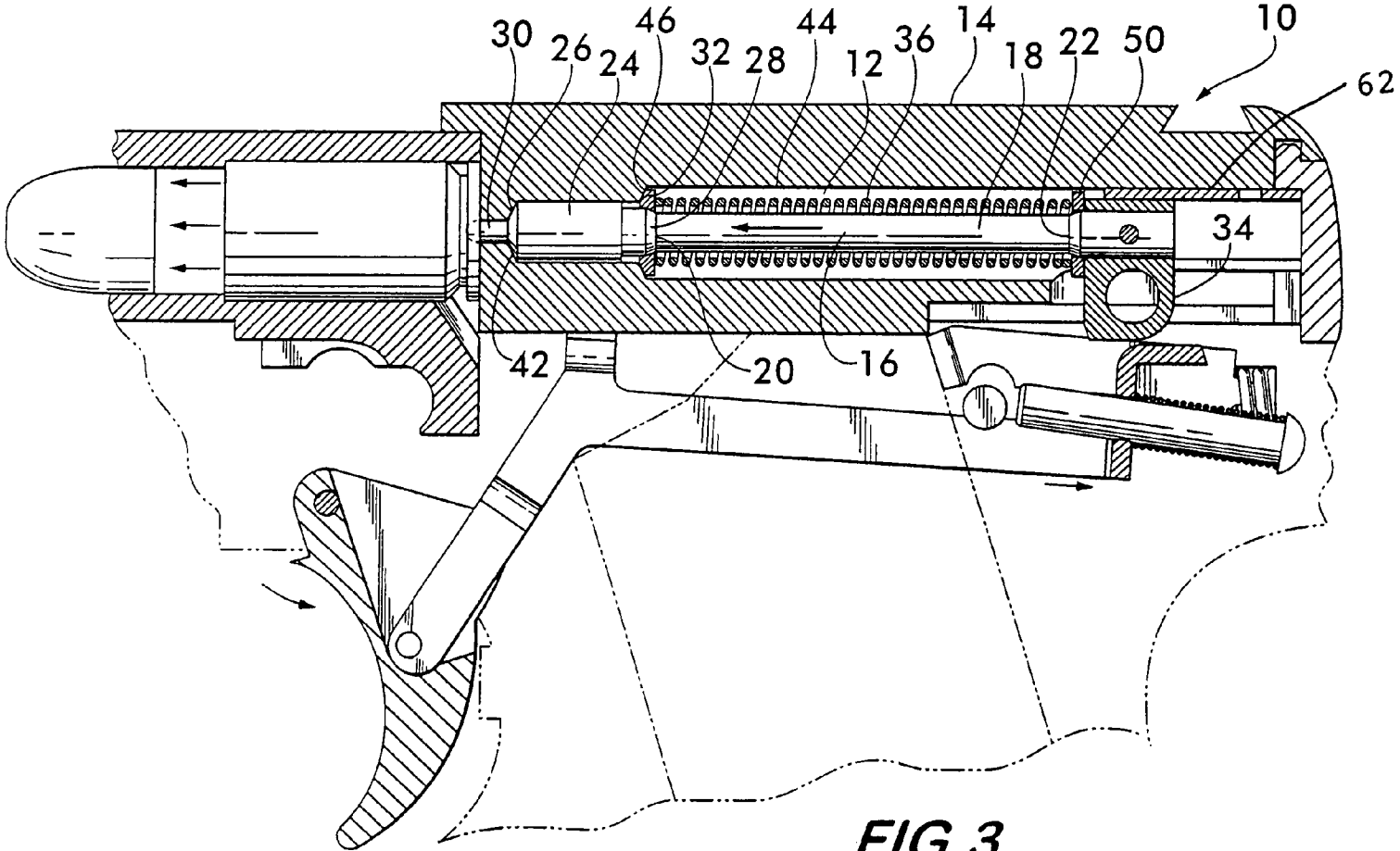
FIG. 3 is a partial, cross-sectional view of the firearm having a double action firing system of FIG. 1, wherein the firing system is shown at the time of firing of the firearm.

When the trigger 58 is pressed, the trigger mechanism (as is well known) causes a sudden release of the cocking piece 34 which drives the firing pin 16 (including first washer 32 forward toward the cartridge in direction A. The first washer 32 abuts second shoulder 46. The inertia of the firing pin 16 due to its movement in direction A causes the firing pin 16 to move passed the "at rest" position of FIG. 1 and protrude momentarily through the breach face 56 such that the firing pin nose 30 fires the cartridge 52 to the position of FIG. 3. Additionally, spring 36 is compressed by movement of the cocking piece 34 (which is integral with the firing pin 16) in direction A. The movement of the firing pin 16 is limited by the first end 26 of the head section 24 of the firing pin 16 contacting the first shoulder 42 of the breech block 14. However, the force of spring 36 now wants to move the firing pin 16 back to the equilibrium position of FIG. 1 because the cocking piece 34, as stated above, the cocking piece 34 (in contact with the second washer 50) has compressed the spring 36. Washer 50 is now under the influence of spring 36.

In prior art striker systems, typically, there are separate springs to drive the firing pin for firing and to retract it.

While the invention has been described in detail and with reference to specific embodiments thereof, it will be apparent to one skilled in the art that various changes and modifications can be made therein without departing from the spirit and scope thereof.

What is claimed is:

1. A firing pin system for a firearm, comprising:

(a) a breech block;

(b) a firing pin slidably disposed in the breech block, comprising:

(i) an elongated body portion having a first end and a second end;

(ii) a head section integral to the first end of the elongated body portion and having a larger cross sectional shape than the elongated body portion, said head section having a first end and a second end, said first end having a firing pin nose integral thereto, the second end to receive a first spring stop; and (iii) a cocking piece integral to the second end of the elongated body portion;

(c) a coil spring surrounding the body portion of the firing pin;

(d) the breech block having a first aperture of a first cross sectional area to slidably receive the firing pin nose, the breech block having a second aperture of a second cross sectional area to slidably receive the head section of the firing pin, coaxial to the first aperture and of a larger cross sectional area such that a first shoulder is formed between the first aperture and the second aperture, wherein the shoulder prevents the firing pin from exiting the breech block;

(e) the breech block having a third aperture of a third cross sectional area to receive the head section of the firing pin and the coil spring, the third aperture coaxial to the first aperture and the second aperture and having a larger cross sectional area such that a second shoulder is formed between the second aperture and the third aperture; and (f) a first spring stop and a second spring stop, the first spring stop slidably disposed on the elongated body portion of the firing pin adjacent to the head section at the second shoulder, the second spring stop slidably disposed on the elongated body portion of the firing pin adjacent to the cocking piece, the coil spring positioned between the two spring stops to urge the first spring stop against the second end of the head section of the firing pin and to simultaneously urge the second spring stop toward the cocking piece.

2. The firing pin system for a firearm of claim 1, wherein the first spring stop and the second spring stop are washers.

3. The firing pin system for a firearm of claim 1, wherein the first, second and third cross sectional areas are generally circular.

* * * * *